United States Patent [19]

Oliff

[11] 4,314,633

[45] Feb. 9, 1982

[54] STACKING DEVICE FOR TIERS OF ARTICLES

[75] Inventor: James R. Oliff, Austell, Ga.

[73] Assignee: The Mead Corporation, Dayton, Ohio

[21] Appl. No.: 92,989

[22] Filed: Nov. 9, 1979

[51] Int. Cl.[3] ..... B65D 75/00

[52] U.S. Cl. ..... 206/148; 206/427; 206/821; 229/DIG. 11

[58] Field of Search ..... 206/151, 427, 433, 434, 206/435, 148, 149, 821, 431, 485; 229/DIG. 11

[56] References Cited

U.S. PATENT DOCUMENTS

| | | | |
|---|---|---|---|
| 2,100,483 | 11/1937 | Jesser | 206/821 |
| 2,883,046 | 4/1959 | Weiner | 206/433 |
| 3,243,220 | 3/1966 | Karas | 206/427 |
| 3,384,229 | 5/1968 | Kaschyk et al. | 206/431 |
| 3,503,498 | 3/1970 | Lawrence | 206/427 |
| 3,670,879 | 6/1972 | Williard et al. | 206/434 |
| 3,700,276 | 10/1972 | Klygis | 206/144 |
| 4,213,529 | 7/1980 | Whitaker | 206/431 |

FOREIGN PATENT DOCUMENTS

| | | | |
|---|---|---|---|
| 86029 | 10/1965 | France | 206/4 X |
| 2198466 | 3/1974 | France | 206/485 |
| 442689 | 11/1948 | Italy | 206/485 |
| 1487220 | 9/1977 | United Kingdom | 206/431 |

*Primary Examiner*—Joseph Man-Fu Moy
*Attorney, Agent, or Firm*—Rodgers & Rodgers

[57] ABSTRACT

In a container for a plurality of articles packaged together by means of a top gripping article carrier including top openings formed in the carrier for receiving the top portions of the associated articles, a stacking device disposed in overlying relation to the carriers and including a main panel, a pair of side panels joined respectively to the side edges of the main panel, and a plurality of notches formed along the lower edges of the side panels, the notches being disposed in general coincidence with the associated top openings.

9 Claims, 4 Drawing Figures

STACKING DEVICE FOR TIERS OF ARTICLES

TECHNICAL FIELD

This invention relates to an economical means for forming multiple tiers of packaged articles in a sturdy and visually appealing manner.

BACKGROUND ART

Primary packages used in the packaging of consumable products such as soft drinks and beer are often formed in multiples and packaged by means of economical top gripping type article carriers. Various examples of this type of carrier are disclosed in U.S. Pat. Nos. 3,387,879; 3,640,563; 3,860,281; and 4,180,191 all of which are owned by the assignee of this invention. Another example of a top gripping carrier is disclosed in U.S. Pat. No. 3,016,259. In usual practice the top gripping carriers are further packaged in larger containers in multiples of two or more. Since the top gripping carriers are formed only around the necks of the associated articles, an inherently unstable condition exists whenever the large containers are stacked one upon the other. In order to provide necessary stability, various forms of full depth inserts are utilized to provide reinforcement especially along the medial portion of the container. These inserts require an inordinately large amount of material and as a result are extremely expensive to produce.

DISCLOSURE OF INVENTION

According to this invention a stacking device for use in connection with multiple tiers of articles is provided and comprises a main panel, a pair of side panels foldably joined respectively to the sides of the main panel and extending downwardly therefrom, and a plurality of notches formed along the lower portion of each of the side panels.

BEST MODE FOR CARRYING OUT THE INVENTION

Figure 1:
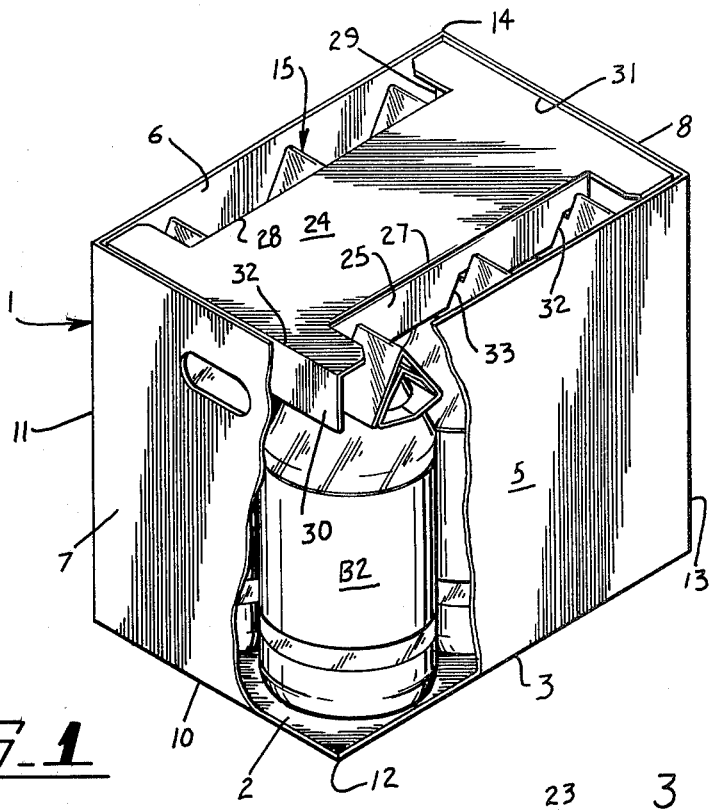
FIG. 1 is an isometric view of a stacking device disposed in a container with a portion of the container broken away.

In order to enhance the efficiency of handling and storing a large number of articles packaged by means of top gripping article carriers, containers such as generally indicated by the numeral 1 in the drawings are utilized. More specifically container 1 comprises bottom 2 to one side edge 3 of which side wall 5 is secured. Side wall 6 is secured to the opposite side edge of bottom 2. In addition end wall 7 is secured to end edge 10 of bottom 2 and end wall 8 is secured to the opposite end edge of bottom 2. Also the ends of the side walls are secured to the associated ends of the end walls at junctions 11, 12, 13 and 14.

Figure 2:
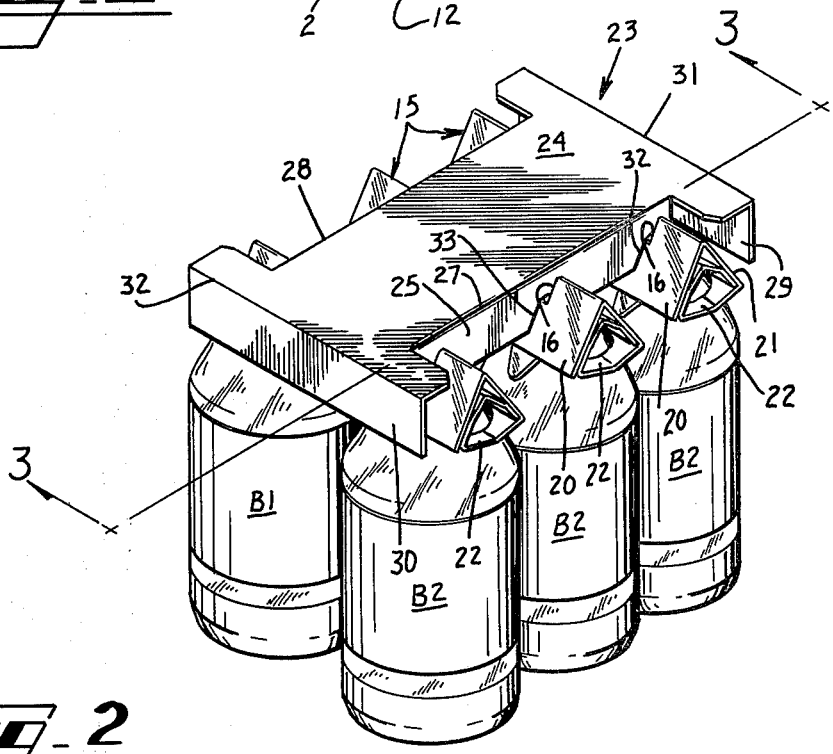
FIG. 2 is an isometric view showing the stacking device as utilized without the container.
Figure 3:
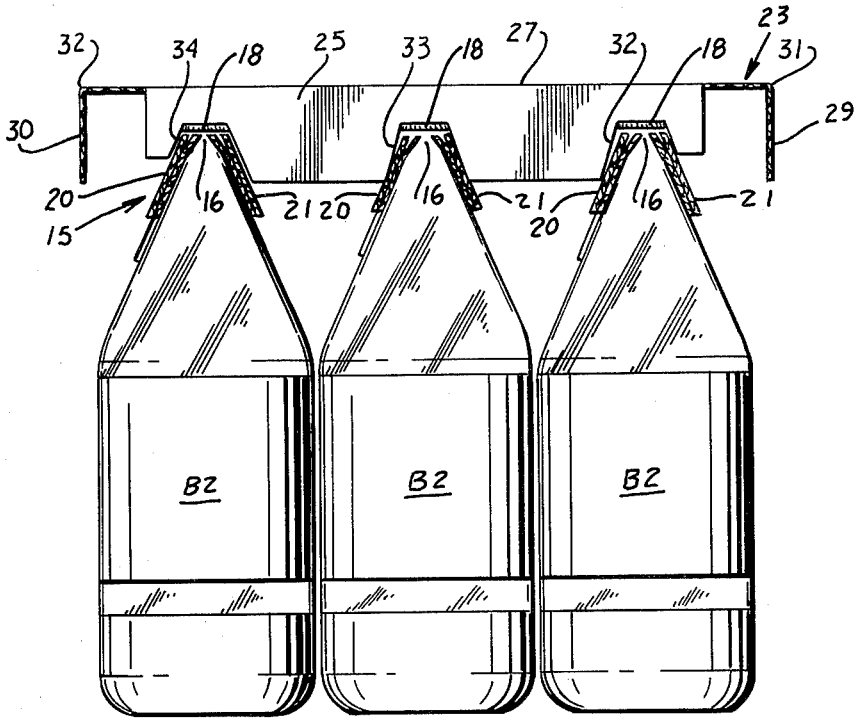
FIG. 3 is a cross-sectional view taken along the line 3—3 in FIG. 2.
Figure 4:
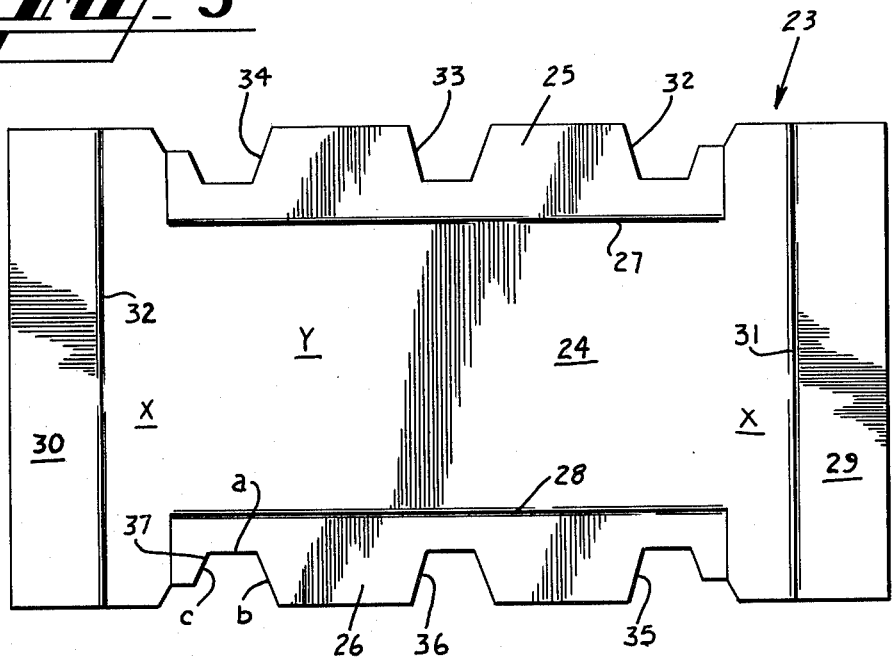
FIG. 4 is a plan view of a blank from which the stacking device is formed.

In the drawings a pair of bottles such as B1 and B2 having upwardly tapered neck portions are packaged by means of a top gripping type article carrier indicated generally by the numeral 15 and best shown in FIGS. 1 and 2. In general the carrier 15 includes a pair of openings one of which is indicated by the numeral 16. Top portion 18 of article B2 is disposed in opening 16 and the top portion of article B1 is disposed in the corresponding opening in each article carrier 15.

Also top gripping carrier 15 comprises inwardly inclined sloping side walls 20 and 21 which are foldably joined along the top edges thereof and separated at the lower edges thereof by means of bottom wall 22. The pertinent details of this carrier are more fully described in U.S. Pat. No. 4,180,191.

According to this invention, a stacking device is provided and is generally indicated by the numeral 23. More specifically stacking device 23 comprises main panel 24 to the sides of which side panels 25 and 26 are foldably joined respectively along fold lines 27 and 28. In addition end panels 29 and 30 are joined to main panel 24 respectively along fold lines 31 and 32.

Formed along the lower portion of side panel 25 are notches 32, 33 and 34 and, in like fashion, notches 35, 36 and 37 are formed along the lower portion of side panel 26. Also each of the notches 32–37 is provided with top edge a and side edges b and c which diverge from the respective ends of top edge a.

According to a feature of this invention, end portions X of main panel 24 are wider than intermediate portion Y. Also in effect fold lines 27 and 28 of main panel 24 define the side edge portions of intermediate portion Y and are disposed generally parallel to each other.

In order to load the container 1, articles such as B1 and B2 are packaged in multiples of two or more by means of top gripping carrier 15. Multiples of these packages are then placed into container 1 such as shown in FIG. 1. Thereafter side panels 25 and 26 and end panels 29 and 30 of stacking device 23 are folded generally upwardly as shown in the drawings into positions whereby they are perpendicular to main panel 24. Stacking device 23 is then inverted and maneuvered into a position whereby the underside thereof and specifically portion Y is disposed in overlying contact with top portions such as 18 of each of the articles B1 and B2 and whereby end panels 29 and 30 are disposed in face contacting relation with the respective inner surfaces of the container end walls.

According to one aspect of this invention side panels 25 and 26 are inserted between the outer edges of the corresponding opening of each article carrier and the adjacent edge of the article top portion disposed therein. Also notches 32–37 assume a coincidental relationship with the corresponding openings, such as indicated by the numeral 16, of each of the top gripping carriers 15. In addition, side edges b and c of each notch are disposed in abutting relationship with the respective sloping side walls 21 and 20 of each top gripping carrier 15.

Therefore by this invention a container having multiple articles packaged by means of top gripping type article carriers disposed therein is extremely sturdy because individual carriers are in effect interlocked and secured between the container side and end walls. Additionally the articles themselves are equal in height to the depth of the container and therefore the articles act as supportive columns in the multiple tier arrangement.

An added advantage of this invention is that the tops of the articles are protected from damage and at the same time any desired promotional material can be printed on the stacking device. Another advantage is that whenever the carriers are removed from container 1 at the point of retail sale, multiple carriers interlocked by means of stacking device 23 and as shown in FIG. 2 can also be stacked into multiple tiers. Heretofore this has been impossible without specialized inserts due to the inherent instability associated with top gripping carriers.

INDUSTRIAL APPLICABILITY

By this invention top gripping type article carriers are displayed and stored in multiple tiers and the need for specialized display devices having individual shelves for use in connection with single layers of bottles is eliminated.

I claim:

1. In combination, a plurality of packages arranged in parallel relation in a single tier, said tier being disposed within a container, said container having a bottom wall and parallel side and end walls, each package including a plurality of articles and a top gripping carrier having side walls with openings for receiving the top portions of the associated articles, a stacking device including a main panel having generally parallel side edges and disposed in overlying relation to said packages, a pair of side panels foldably joined to the side edges of said main panel and folded downwardly and into said top openings, said main panel comprising an intermediate portion and at least one end portion, and said end portion being substantially equal to the corresponding horizontal dimension of said container.

2. An arrangement according to claim 1 wherein said side panels include a plurality of notches formed along their lower edges and arranged in generally coincidental relation to said openings.

3. An arrangement according to claim 1 wherein said side panels are interposed between the outer edges of the outermost ones of said openings and the top portions of the associated articles.

4. An arrangement according to claim 2 wherein the side edges of said notches are disposed in abutment with said side walls of said carriers.

5. An arrangement according to claim 2 wherein said side walls are inwardly inclined and wherein said side edges of said notches are similarly configured.

6. An arrangement according to claim 1 wherein an end panel is foldably joined to each end edge of said main panel and folded downwardly.

7. An arrangement according to claim 1 wherein the articles have inwardly and upwardly tapered neck portions and wherein the width of a part of said main panel intermediate the ends is such that said part of said main panel overlies the tops of all of the articles comprising each package.

8. An arrangement according to claim 1 wherein the height of said side and end walls is approximately the same as the height of the articles.

9. An arrangement according to claim 8 wherein said stacking device includes end panels foldably joined respectively to the ends of said main panels and wherein said end panels are in flat face contacting relation with the interior surfaces of said end walls of said container.

* * * * *